US007845637B2

(12) United States Patent
Shimazaki

(10) Patent No.: US 7,845,637 B2
(45) Date of Patent: Dec. 7, 2010

(54) DOUBLE FEED DETECTING DEVICE AND METHOD OF CONTROLLING THE DOUBLE FEED DETECTING DEVICE

(75) Inventor: Tomoya Shimazaki, Ageo (JP)

(73) Assignee: Canon Denshi Kabushiki Kaisha, Chichibu-Shi (JP)

( * ) Notice: Subject to any disclaimer, the term of this patent is extended or adjusted under 35 U.S.C. 154(b) by 57 days.

(21) Appl. No.: 11/870,072

(22) Filed: Oct. 10, 2007

(65) Prior Publication Data

US 2008/0088084 A1 Apr. 17, 2008

(30) Foreign Application Priority Data

Oct. 17, 2006 (JP) ..... 2006-282691

(51) Int. Cl.
*B65H 7/12* (2006.01)
*B65H 7/02* (2006.01)

(52) U.S. Cl. ..... 271/262; 271/263; 271/259; 271/265.04; 271/265.02

(58) Field of Classification Search ..... 271/263, 271/262, 258.01, 259, 265.01, 265.04, 265.02
See application file for complete search history.

(56) References Cited

U.S. PATENT DOCUMENTS

| | | | | |
|---|---|---|---|---|
| 4,066,969 | A * | 1/1978 | Pearce et al. | 367/125 |
| 4,368,438 | A * | 1/1983 | Stienstra | 331/14 |
| 4,707,598 | A * | 11/1987 | Croset et al. | 250/223 R |
| 5,861,646 | A * | 1/1999 | Czesnik et al. | 250/559.4 |
| 6,397,671 | B1 * | 6/2002 | Nishio et al. | 73/159 |
| 6,511,064 | B1 * | 1/2003 | Phinney et al. | 271/262 |
| 6,739,591 | B2 * | 5/2004 | Chujo et al. | 271/262 |
| 7,018,121 | B2 * | 3/2006 | Barry et al. | 400/708 |
| 7,025,348 | B2 * | 4/2006 | Phinney et al. | 271/262 |
| 7,107,903 | B2 * | 9/2006 | Tokinaga et al. | 101/232 |
| 7,445,209 | B2 * | 11/2008 | Sano et al. | 271/263 |
| 2001/0035603 | A1 * | 11/2001 | Graves et al. | 271/265.01 |
| 2001/0042956 | A1 * | 11/2001 | Minoru et al. | 271/265.04 |
| 2002/0079644 | A1 * | 6/2002 | Phinney | 271/258.01 |
| 2004/0150155 | A1 | 8/2004 | Okitsu et al. | |

FOREIGN PATENT DOCUMENTS

| | | |
|---|---|---|
| JP | 8-48439 | 2/1996 |
| JP | 2000-61407 | 2/2000 |
| JP | 2004-231403 | 8/2004 |

* cited by examiner

*Primary Examiner*—Stefanos Karmis
*Assistant Examiner*—Luis Gonzalez
(74) *Attorney, Agent, or Firm*—Fitzpatrick, Cella, Harper & Scinto

(57) ABSTRACT

Provided is a double feed detecting device, including: a first detecting unit which is disposed in a conveyance path of a sheet member, and detects overlapping of the sheet members which pass along the conveyance path; a second detecting unit having a light emitting unit and a light receiving unit which are opposed each other and disposed across the conveyance path, and detecting light which is irradiated from the light emitting unit and transmitted through the sheet member by the light receiving unit, and outputting a signal corresponding to a received light quantity; and a discriminating unit which discriminates the double feed when the first detecting unit detects the overlapping of the sheet members and an output signal of the second detecting unit is equal to or lower than a set double feed determination threshold value.

3 Claims, 4 Drawing Sheets

DOUBLE FEED DETECTING DEVICE AND METHOD OF CONTROLLING THE DOUBLE FEED DETECTING DEVICE

BACKGROUND OF THE INVENTION

1. Field of the Invention

The present invention relates to a double feed detecting device of sheet members and a method of controlling the double feed detecting device in a feeding device which mounts a plurality of sheet members thereon, and separates and feeds the sheet members one by one. In particular, the present invention relates to double feed detection in feeding the sheet members while the sheet members are enclosed in an envelope for a sheet member feed protection.

2. Description of the Related Art

As a conventional sheet member feeding device, there is provided a device which separates and feeds sheet members one by one, for example, in a scanner or a copying machine. There is a fear in that there occurs a double feed such as parts or all of two or more sheet members are fed while those sheet members are being overlapped with each other despite that only one sheet member should be fed. For that reason, a function for detecting the double feed is required for the sheet member feeding device. As the device for detecting the double feed of the sheet members, there has been become widespread an ultrasonic double feed detecting device for detecting an air spacer between overlapping papers by an aid of ultrasonic waves in the diverse fields, as disclosed in Japanese Patent Application Laid-Open No. 2004-231403.

FIG. 4 is a diagram showing an outline of a conventional ultrasonic double feed detecting device. In FIG. 4, a sheet member A01 to be fed is a paper in this example. An ultrasonic transmitting portion A02 transmits ultrasonic waves to a paper A01. An ultrasonic receiving portion A03 receives ultrasonic waves transmitted by the ultrasonic transmitting portion A02. Also, as shown in FIG. 4, the ultrasonic receiving portion A03 is so disposed as to face the ultrasonic transmitting portion A02 through a path of the paper A01 so as to receive the ultrasonic waves, which have been transmitted through the paper A01. A waveform analyzing portion A04 analyzes a receiving signal of the ultrasonic waves, which have been received by the ultrasonic receiving portion A03, and detects the double feed.

The double feed detecting device shown in FIG. 4 analyzes a change in an amplitude or a phase of the received ultrasonic waves through the waveform analyzing portion A04 to detect the double feed. A system which detects the double feed based on a change in the amplitude of the ultrasonic receiving signal is called "level determining system," and a system which detects the double feed based on a change in the phase of the ultrasonic receiving signal is called "a phase determining system."

The level determining system will be further described. The ultrasonic receiving portion A03 receives the amplitude of the ultrasonic waves, which have been transmitted through the paper A01 during feeding the paper A01. The amplitude of the ultrasonic receiving signal is small because attenuation of the ultrasonic waves is large in a case where the paper A01 is doubly fed as compared with the amplitude of the ultrasonic receiving signal in a case where the paper A01 is normally fed one by one. Accordingly, the amplitude of the ultrasonic waves which have been received by the ultrasonic receiving portion A03 is compared with a predetermined double feed determination threshold value in the waveform analyzing portion A04, thereby making it possible to detect the double feed of the paper A01 based on a comparison result.

The phase determining system will be further described. The phase information on the ultrasonic receiving signal which has been obtained by the ultrasonic receiving portion A03 is held a given period of time after a timing when the ultrasonic waves are transmitted from the ultrasonic transmitting portion A02. The phase information when no paper A01 exists between the ultrasonic transmitting portion A02 and the ultrasonic receiving portion A03 is set as basic phase information. The phase information during feeding the paper A01 is compared with the basic phase information, thereby making it possible to detect the double feed of the paper A01 based on comparison results.

As disclosed in Japanese Patent Application Laid-Open No. 2000-061407 or Japanese Patent Application Laid-Open No. H08-048439, there has been proposed an optical double feed detecting device which detects the overlapping sheet members by means of an optical sensor.

In the sheet member feeding device, there is a case where the sheet members are enclosed in a transparent or semi-transparent feed protection envelope, and then fed because of prevention of the sheet members from being damaged or a damaged sheet member, except that a normal sheet member is fed.

In the double feed detecting device using the ultrasonic waves in the sheet member feeding device as described in the description of the related art, it is impossible to discriminate a case where the sheet members are doubly fed and a case where the sheet members are enclosed in the envelope for the sheet member feed protection and then fed. For that reason, in the case where the sheet members are enclosed in the sheet member feed protection envelope and fed, the ultrasonic double feed detection must be nullified.

In the device for detecting the overlapping sheet members by means of the optical sensor, the transparent envelope cannot be detected.

SUMMARY OF THE INVENTION

The present invention provides a double feed detecting device which is capable of accurately detecting the double feed of sheet members even in the case where the sheet members are enclosed in a sheet member feed protection envelop and fed, and a method of controlling the double feed detecting device.

In order to attain the above-mentioned object of the present invention, a double feed detecting device according a first aspect of the invention includes:

a first detecting unit which is disposed in a conveyance path of a sheet member, and detects overlapping of the sheet members which pass along the conveyance path; a second detecting unit having a light emitting unit and a light receiving unit which are opposed each other and disposed across the conveyance path, and detecting light which is irradiated from the light emitting unit and transmitted through the sheet member by the light receiving unit, and outputting a signal corresponding to a received light quantity; and a discriminating unit which discriminates the double feed when the first detecting unit detects the overlapping of the sheet members and an output signal of the second detecting unit is equal to or lower than a set double feed determination threshold value.

A method of controlling a double feed detecting device which detects the double feed of sheet members by an aid of a light emitting unit and a light receiving unit which are opposed each other and disposed across a conveyance path along which the sheet members are fed, the method according a second aspect of the invention comprising: a first detecting step of detecting overlapping of the sheet members which pass along the conveyance path; a second detecting step of detecting light which has been irradiated from the light emitting unit and transmitted through the sheet member by the light receiving unit, and outputting a signal corresponding to a received light quantity; and a discriminating step of discriminating the double feed when the overlapping of the sheet members is detected in the first detecting step and an output signal in the second detecting step is equal to or lower than a set double feed determination threshold value.

The above and other objects, features, and advantages of the invention will become more apparent from the following description taken in conjunction with the accompanying drawings.

DESCRIPTION OF THE PREFERRED EMBODIMENTS

Hereinafter, a description will be given in more detail of the best mode for carrying out the present invention according to an embodiment of a double feed detecting device.

Figure 1:
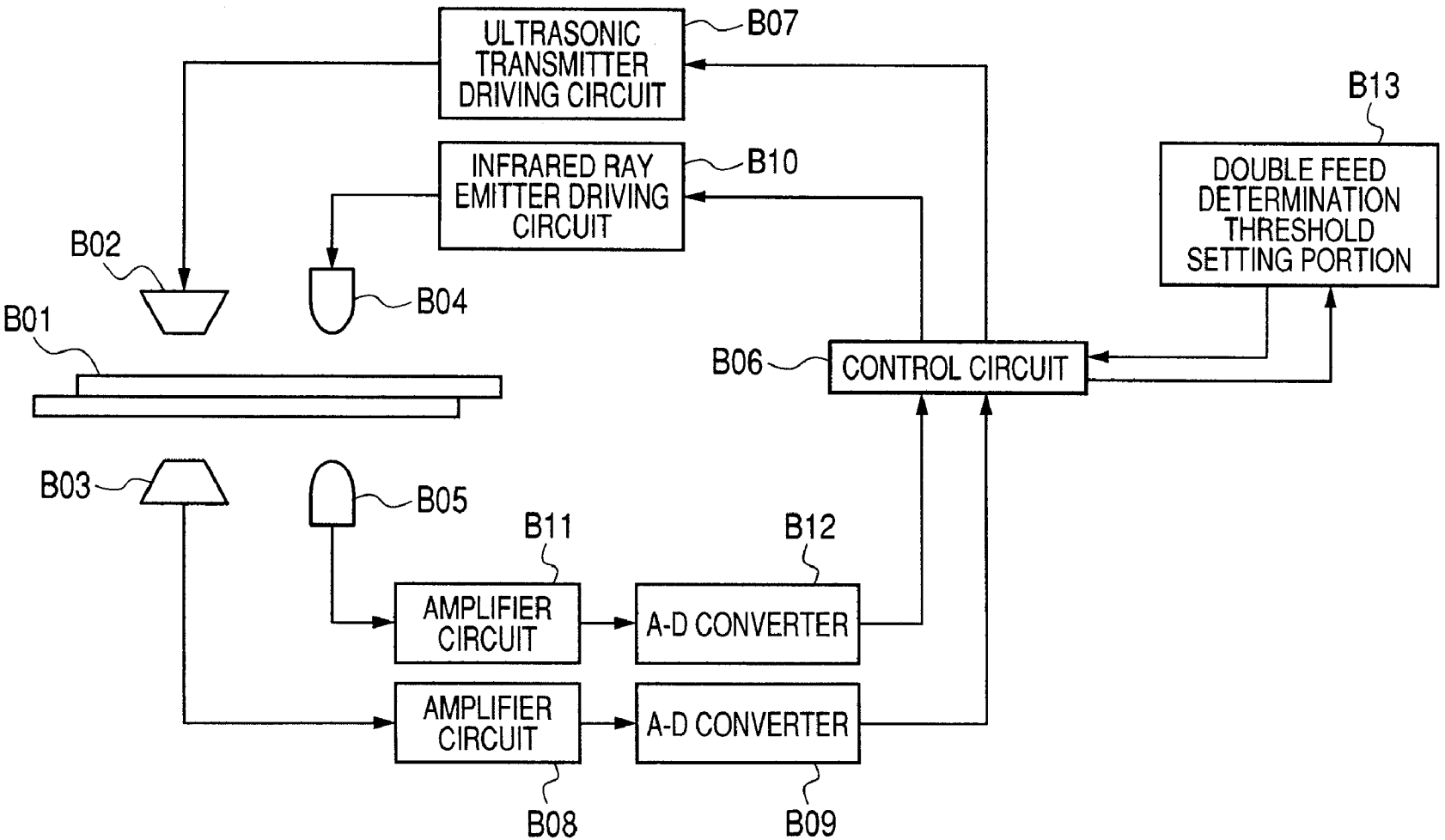
FIG. 1 is a block diagram showing a configuration of a first embodiment.

FIG. 1 is a block diagram showing the configuration of "double feed detecting device" according to a first embodiment. This embodiment detects an air spacer on an overlapping portion of sheet members by the aid of an ultrasonic sensor, and detects a double feed of the sheet members. Reference numeral B01 denotes a paper of a sheet member to be fed, and a conveyance path is interposed between an ultrasonic transmitter B02 and an ultrasonic receiver B03.

When an ultrasonic generation pulse is input to the ultrasonic transmitter B02, an ultrasonic signal is transmitted from the ultrasonic transmitter B02. When a paper exists in the conveyance path, the ultrasonic signal is transmitted through the paper, and received by the ultrasonic receiver B03. When no paper exists in the conveyance path, the ultrasonic signal is directly received by the ultrasonic receiver B03. A control circuit B06 supplies a pulse signal of 200 KHz to an ultrasonic transmitter driving circuit B07. After the ultrasonic transmitter driving circuit B07 amplifies the pulse signal, the ultrasonic transmitter B02 transmits the ultrasonic wave of 200 KHz based on the amplified pulse signal. The frequency of the ultrasonic wave is an example, and other frequencies are also available, and multiple frequencies can be used.

When a paper to be fed is inserted between the ultrasonic transmitter B02 and the ultrasonic receiver B03, the ultrasonic waves which are transmitted from the ultrasonic transmitter B02 attenuate by the ultrasonic waves reach the ultrasonic receiver B03. For that reason, the signal is amplified by an amplifier circuit B08, and boosted to signal amplitude, which can be determined by double feed detection.

An A-D converter B09 converts an analog signal which is an ultrasonic receiving signal which has been amplified by the amplifier circuit B08 to a digital signal, and outputs the digital signal to the control circuit B06.

When there occurs the double feed where the papers to be fed are overlapped with each other and are fed, the ultrasonic receiving signal largely attenuates due to an air spacer in the overlapping portion of the sheet members. Simultaneously, the phase of the ultrasonic waves greatly changes as compared with that in the case of a single sheet member. The control circuit B06 detects the presence of the overlapping portion of the papers to be fed based on the attenuation of the ultrasonic receiving signal and the state of the phase change.

The overlapping can be detected by a mechanical manner without using the ultrasonic waves. In this embodiment, an infrared ray transmission quantity detecting device in which the conveyance path of the sheet member is interposed between an infrared ray emitter B04 and an infrared ray receiver B05 is added to the ultrasonic double feed detecting device using the above-described ultrasonic sensor. When a regular current flows in the infrared ray emitter B04, infrared rays are irradiated, transmitted through the paper when the paper exists in the conveyance path, and received by the infrared ray receiver B05. When no paper exists in the conveyance path, the infrared ray is directly received by the infrared ray receiver B05.

The control circuit B06 supplies an infrared ray emission signal to an infrared ray emitter driving circuit B10, and allows the infrared ray emitter to emit the infrared rays. The infrared ray emission quantity can be controlled by the control circuit B06. When a paper to be fed is inserted between the infrared ray emitter B04 and the infrared ray receiver B05, the infrared rays irradiated by the infrared ray emitter B04 attenuate by the infrared rays reach the infrared ray receiver B05. For that reason, the signal is amplified by an amplifier circuit B11, and boosted to a signal level where a difference of the transmitted infrared ray quantity can be analyzed.

An A-D converter B12 converts an analog signal, which has been amplified by the amplifier circuit B11 to a digital signal, and outputs the digital signal to the control circuit B06.

The receiving signal intensity of the infrared ray which has been transmitted through a single opaque sheet member is set as a receiving signal intensity 1. The receiving signal intensity of the infrared ray which has been transmitted through a single transparent or semi-transparent sheet member and a single opaque sheet member which are overlapped with each other is set as a receiving signal intensity 2. The receiving signal intensity of the infrared ray which has been transmitted through two opaque sheet members which are overlapped with each other and fed is set as a receiving signal intensity 3.

Because the infrared rays are small in the attenuation in the transparent or semi-transparent sheet members, there is no large difference between the receiving signal intensity 1 and the receiving signal intensity 2. However, because there is a large difference between the receiving signal intensity 2 and the receiving signal intensity 3, those intensities can be clearly distinguishable by the control circuit B06.

The control circuit B06 compares a threshold value which is set to distinguish the receiving signal intensity 2 and the receiving signal intensity 3 from each other with a receiving signal intensity of the transmitted infrared ray. It is discriminated whether it is "a state where there is a single opaque sheet member, or a single transparent or semi-transparent sheet member and a single opaque sheet member are overlapped with each other", or "a state where two or more opaque sheet members are overlapped with each other".

When the paper to be fed is thin, there is a feature that the receiving signal intensity of the ultrasonic waves is strong, and the receiving signal intensity of the infrared ray is also strong at the same time. When the paper to be fed is thick, there is a feature that the receiving signal intensity of the ultrasonic waves is weak, and the receiving signal intensity of the infrared ray is also weak at the same time.

The control circuit B06 is capable of analyzing the ultrasonic wave receiving signal intensity to estimate the thickness of the paper, calculates the double feed determination threshold value for distinguishing the receiving signal intensity 2 and the receiving signal intensity 3, and outputting the calculated double feed determination threshold value to a double feed determination threshold setting portion B13.

The double feed determination threshold setting portion B13 can set the threshold value for distinguishing the receiving signal intensity 2 and the receiving signal intensity 3 from each other to a fixed value.

At a stage where the overlapping of the papers to be fed is detected according to the ultrasonic receiving signal, the control circuit B06 does not discriminate the double feed of the paper, and further refers to the receiving signal intensity of the infrared rays. When it is determined that the receiving signal intensity of the transmitted infrared rays is further indicative of a case where two opaque sheet members are overlapped with each other and fed provided that the overlapping of the papers to be fed is detected according to the ultrasonic receiving signal, it is discriminated that the papers are doubly fed.

It is determined according to the receiving signal intensity of the transmitted infrared rays that a single opaque sheet member, or a single or a plurality of transparent sheet members and a single opaque sheet member are overlapped with each other and fed, provided that the overlapping of the papers to be fed is detected according to the ultrasonic receiving signal. This means that the sheet members are enclosed in the sheet member feed protection envelope and fed. For that reason, it is discriminated that the sheet is normally fed.

When the sheet members are enclosed in the sheet member feed protection envelope and fed, the ultrasonic waves detect the overlapping of the papers over the substantially entire area extended from a leading end to a trailing end of the paper to be fed. This is an index by which the control circuit B06 discriminates that the envelope has been fed.

In the case where the overlapping of the paper to be fed is detected according to the ultrasonic receiving signal, there is required the receiving signal intensity information of transmitted infrared rays in order to discriminate the envelope. In the case where the overlapping of the paper to be fed is not detected according to the ultrasonic receiving signal, the emission of the infrared rays can be stopped.

The control circuit B06 controls the infrared ray emitter driving circuit B10 based on the ultrasonic receiving signal intensity which is obtained by the analysis of the ultrasonic receiving signal so as to change the emission quantity (light intensity) of the infrared rays.

Figure 2:
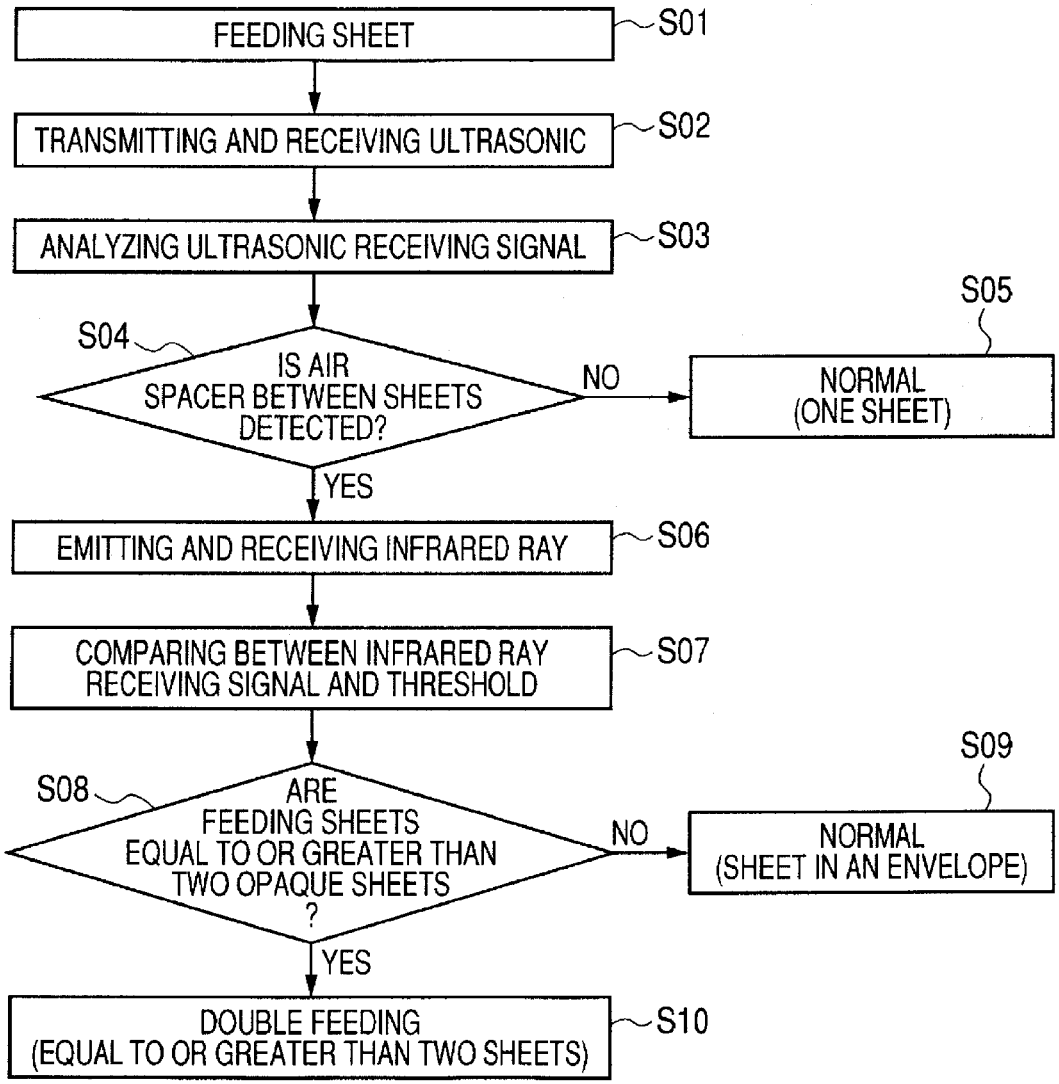
FIG. 2 is a flowchart showing the processing of the first embodiment.

FIG. 2 is a flowchart showing the double feed discriminating process according to this embodiment. The paper B01 passes between the ultrasonic transmitter B02 and the ultrasonic receiver B03 by the aid of paper feed in Step S01. In Step S02, the ultrasonic waves are transmitted and received, and the ultrasonic receiving signal is transmitted to the control circuit B06. The control circuit B06 analyzes the ultrasonic receiving signal in Step S03. It is determined whether the air spacer between the papers is detected, or not, in Step S04. When the air spacer is not detected, it is determined that the paper (single paper) has been normally fed in Step S05.

When the air spacer between the papers is detected in Step S04, the infrared rays are emitted and received, and the infrared ray receiving signal is transmitted to the control circuit B06 in Step S06. The control circuit B06 compares the infrared ray receiving signal intensity with the threshold value in Step S07. The threshold value changes according to the receiving signal intensity of the ultrasonic waves as a result of analyzing the ultrasonic receiving signal in Step S03. The threshold value can be set to a fixed value. In Step S07, the infrared ray receiving signal intensity is compared with the threshold value, and it is determined whether the paper to be fed is two or more opaque paper to be fed in Step S08. When it is not determined that the paper to be fed is not two or more opaque papers to be fed, it is estimated that the paper to be fed is enclosed in the envelope in Step S09. For that reason, it is determined that the feed is normal. When it is determined that the paper to be fed is two or more opaque papers to be fed, it is determined that the double feed is conducted in Step S10.

Figure 3:
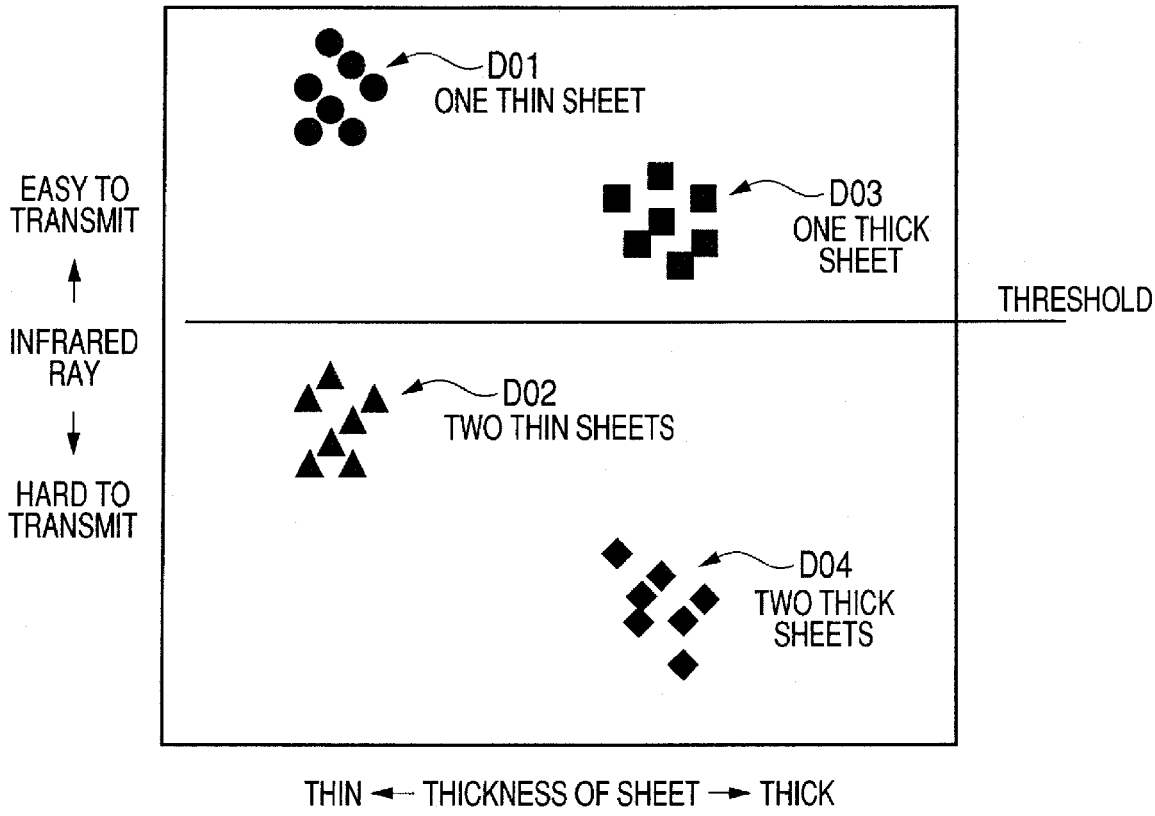
FIG. 3 is a correlation diagram showing the thickness of a paper and ease to transmit an infrared ray.
Figure 4:
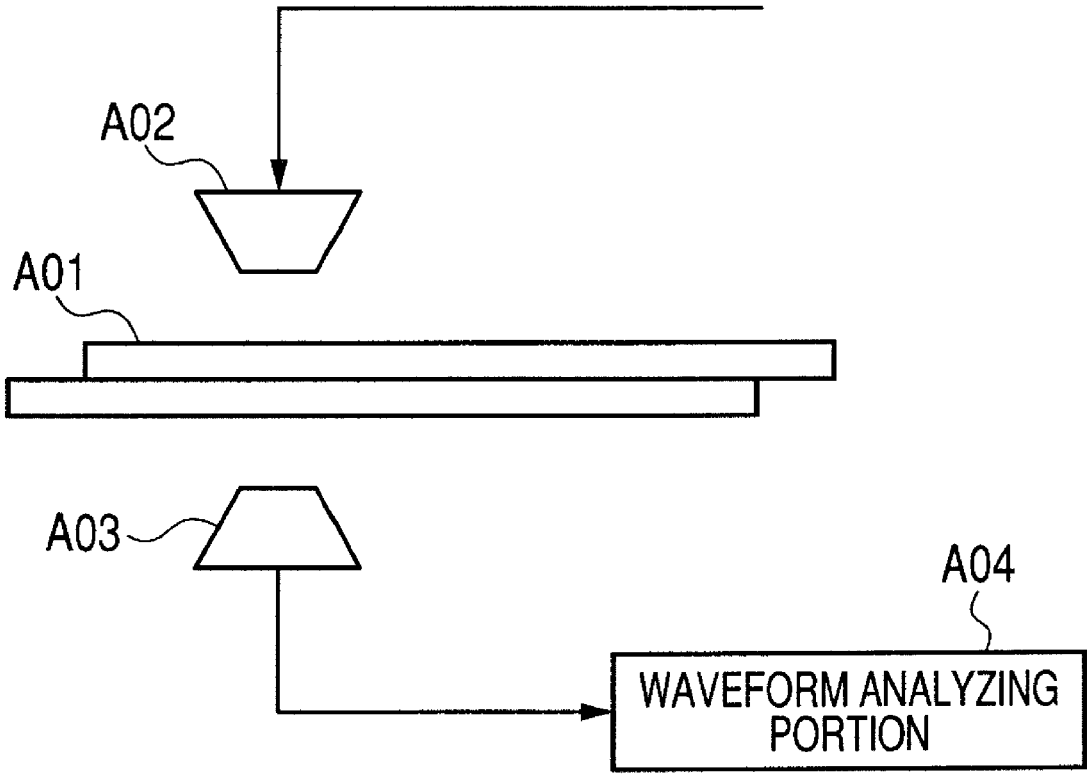
FIG. 4 PRIOR ART
FIG. 4 is a diagram showing the outline of a related art.

FIG. 3 is a correlation diagram showing the thickness of a paper and ease to transmit an infrared ray, which is used as a reference which sets the threshold value for distinguishing the receiving signal intensity 2 and the receiving signal intensity 3 from each other. Reference D01 denotes a group of a single thin paper, and in a case where the paper is thin, it is easy to transmit the infrared rays. D02 is a group of two thin papers which is hard to transmit the infrared rays as compared with D01. D03 is a group of a single thick paper, which is hard to transmit the infrared rays when the paper is thick as compared with a case where the paper is thin in D01. D04 is a group of two thick papers, which is further hard to transmit the infrared rays as compared with D03.

The transmission of the infrared rays which are transmitted through the single thin paper of D01 is substantially equal to the transmission in the case where a transparent sheet material is overlapped with the single thin paper. The transmission of the infrared rays which are transmitted through the single thick paper of D03 is also substantially equal to the transmission in the case where a transparent sheet material is overlapped with the single thick paper.

In the case where the double feed determination threshold value is set to a fixed value, it is desirable that the fixed value be set between D01 and D02, and between D03 and D04 as shown in FIG. 3. In the case where the control circuit B06 changes the double feed determination threshold value, the control circuit B06 changes the double feed determination threshold value to be higher than that shown in FIG. 3 when it is estimated that the paper is thin based on the ultrasonic receiving signal intensity which is obtained by the analysis of the ultrasonic receiving signal. The control circuit B06 changes the double feed determination threshold value to be lower than that shown in FIG. 3 when it is estimated that the paper is thick.

A microcomputer can be used as the control circuit B06. The above double feed determining process can be executed by a program of the microcomputer. The double feed determination threshold setting portion B13 can be incorporated into the microcomputer, or can be realized as a function of the program.

The optical sensor can use a visible light, or can use diverse light sources such as an LED or a laser.

As has been described above, in the conventional double feed detecting manner using the ultrasonic waves of the sheet member feeding device, it is impossible to discriminate a case where the sheet members are doubly fed and a case where the sheet members are enclosed in the envelope for the sheet member feed protection and then fed. For that reason, in the case where the envelope is fed, the ultrasonic double feed detecting function must be nullified.

In this embodiment, the transmitted infrared ray quantity of the sheet member is added to the determination reference with the result that it is possible to discriminate a case where the sheet members are further enclosed in the envelope, and a case where the sheet members are doubly fed, and the double feed detection is enabled even at the time of feeding the envelope.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-282691, filed Oct. 17, 2006, which is hereby incorporated by reference herein in its entirety.

What is claimed is:

1. A double feed detecting device comprising:

a first detecting unit having an ultrasonic transmitting unit and an ultrasonic receiving unit which are opposed to each other and disposed across a conveyance path of a sheet member, said first detecting unit detecting overlapping of the sheet members which pass along the conveyance path;

a second detecting unit having a light emitting unit and a light receiving unit which are opposed to each other and disposed across the conveyance path, and detecting light which is irradiated from the light emitting unit and transmitted through the sheet member by the light receiving unit, and outputting a signal corresponding to a received light quantity; and a discriminating unit which discriminates the double feed when the first detecting unit detects the overlapping of the sheet members and an output signal of the second detecting unit is equal to or lower than a set double feed determination threshold value;

wherein the first detecting unit detects an air spacer on the overlapping portion of the sheet members, and wherein the discriminating unit estimates a thickness of the sheet member with the air spacer which passes along the conveyance path based on a function of the first detecting unit, and changes a setting of the double feed determination threshold value.

2. A double feed detecting device comprising:

a first detecting unit having an ultrasonic transmitting unit and an ultrasonic receiving unit which are opposed to each other and disposed across a conveyance path of a sheet member, said first detecting unit detecting overlapping of the sheet members which pass along the conveyance path;

a second detecting unit having a light emitting unit and a light receiving unit which are opposed to each other and disposed across the conveyance path, and detecting light which is irradiated from the light emitting unit and transmitted through the sheet member by the light receiving unit, and outputting a signal corresponding to a received light quantity; and a discriminating unit which discriminates the double feed when the first detecting unit detects the overlapping of the sheet members and an output signal of the second detecting unit is equal to or lower than a set double feed determination threshold value;

wherein the first detecting unit detects an air spacer on the overlapping portion of the sheet members, and wherein the discriminating unit estimates the thickness of the sheet member with the air spacer which passes along the conveyance path based on the function of the first detecting unit, and changes emission intensity of the light emitting unit.

3. A double feed detecting device comprising:

a first detecting unit having an ultrasonic transmitting unit and an ultrasonic receiving unit which are opposed to each other and disposed across a conveyance path of a sheet member, said first detecting unit detecting overlapping of the sheet members which pass along the conveyance path;

a second detecting unit having a light emitting unit and a light receiving unit which are opposed to each other and disposed across the conveyance path, and detecting light which is irradiated from the light emitting unit and transmitted through the sheet member by the light receiving unit, and outputting a signal corresponding to a received light quantity; and a discriminating unit which discriminates the double feed when the first detecting unit detects the overlapping of the sheet members and an output signal of the second detecting unit is equal to or lower than a set double feed determination threshold value;

wherein the first detecting unit detects an air spacer on the overlapping portion of the sheet members, and wherein the discriminating unit estimates a thickness of the sheet member with the air spacer according to intensity of a signal which is transmitted through the sheet member by the ultrasonic transmitting unit and received by the ultrasonic receiving unit.

* * * * *